US007500674B2

(12) United States Patent
Riley et al.

(10) Patent No.: US 7,500,674 B2
(45) Date of Patent: Mar. 10, 2009

(54) WASHER TOSSING GAME

(75) Inventors: Todd A. Riley, Shawnee, KS (US); Jeff Knoche, Frisco, TX (US)

(73) Assignee: All About Washers, LLC, Shawnee, KS (US)

( * ) Notice: Subject to any disclaimer, the term of this patent is extended or adjusted under 35 U.S.C. 154(b) by 231 days.

(21) Appl. No.: 11/005,282

(22) Filed: Dec. 6, 2004

(65) Prior Publication Data

US 2006/0119031 A1 Jun. 8, 2006

(51) Int. Cl.
*A63B 71/00* (2006.01)

(52) U.S. Cl. ..... 273/400; 273/126 R; 273/398

(58) Field of Classification Search ..... 273/126 R, 273/126 A, 398, 400–402; D21/303
See application file for complete search history.

(56) References Cited

U.S. PATENT DOCUMENTS

| | | | | |
|---|---|---|---|---|
| 324,189 | A * | 8/1885 | Thomas | 273/400 |
| 4,392,653 | A * | 7/1983 | Blume, Sr. | 273/400 |
| 4,872,679 | A * | 10/1989 | Bohaski et al. | 273/317.5 |
| 4,974,858 | A | 12/1990 | Knowlton | |
| 4,982,966 | A * | 1/1991 | Teafatiller | 273/338 |
| 4,989,880 | A * | 2/1991 | Gettemeier et al. | 273/336 |
| 5,018,745 | A * | 5/1991 | Dunse | 273/338 |
| 5,040,801 | A * | 8/1991 | Weymuth | 273/338 |
| 5,664,776 | A * | 9/1997 | Mateer | 273/126 R |
| 6,161,833 | A | 12/2000 | Gomez | |
| 6,669,200 | B1 * | 12/2003 | Knetsch et al. | 273/400 |
| 6,749,201 | B2 * | 6/2004 | Kessler et al. | 273/400 |
| D498,503 | S * | 11/2004 | Worth | D21/303 |
| 7,134,662 | B2 * | 11/2006 | Menendez | 273/400 |
| 2002/0175469 | A1 * | 11/2002 | Kessler et al. | 273/400 |
| 2004/0227284 | A1 * | 11/2004 | Christianson | 273/126 R |
| 2005/0051968 | A1 * | 3/2005 | Froesel | 273/336 |
| 2006/0022409 | A1 * | 2/2006 | Zimmermann | 273/400 |
| 2006/0066054 | A1 * | 3/2006 | Menendez | 273/348 |
| 2006/0066055 | A1 * | 3/2006 | Menendez | 273/398 |
| 2006/0119031 | A1 * | 6/2006 | Riley et al. | 273/126 R |

OTHER PUBLICATIONS

Web site: http://store.yahoo.com/bombatwashers/index.html as of Jun. 18, 2004.

* cited by examiner

*Primary Examiner*—Raleigh W. Chiu
(74) *Attorney, Agent, or Firm*—Intellectual Property Center, LLC; Arthur K Shaffer

(57) ABSTRACT

A washer tossing game for players to score the tossing of projectiles, including a storage container comprised of plural receiving boxes at least two of which are positioned in juxtaposed positions each box having a receiver base for receiving a removable center section, the removable center section being adapted to receive plural tossed projectiles. Alternatively, the game may include beveled center sections which are received by the receiver bases. Optionally, the game can include alternative center sections, allowing the game to be adapted to varying skill levels. In addition, the game may optionally include additional features including visual highlights, protective sidewall curbing and impact resistant lining to protect the boxes from the impact of the thrown projectiles. A carrying case and a handle may also be provided allowing the game to be easily transported.

7 Claims, 4 Drawing Sheets

WASHER TOSSING GAME

BACKGROUND OF THE INVENTION

1. Field of the Invention

The present invention relates generally to the field of games and in particular to a portable, lightweight, compact washer tossing game.

2. Description of the Related Art

Washer tossing games are known in the prior art. The fact that these fundamentally simple games have a wide base of enjoyment and appeal among those individuals who play the games is reflected in the range of patents issued on the subject. The basic concept of using circular disks in tossing games has been used for a number of years in a variety of different configurations. One current type of washer tossing game in use includes two cylinders inserted into the ground into which washers are tossed. In this configuration, the game is limited to outdoor areas where the ground is penetratable. Obviously this configuration imposes limitations on the areas in which the game can be played. In areas such as parking lots, basements or other areas where the ground is highly compact, the spikes would have trouble penetrating the ground surface. It would be an advantage to have a washer tossing game which could be performed in a wide variety of locations, including parking lots, indoors or areas of highly compact soil.

An additional configuration of the washer tossing game involves the use of receiving boxes in which the boxes contained hollow cylinders permanently attached to the boxes. Because current washer tossing games involve the use of permanently fixed cylinders, the ability to transport the game is more difficult because the cylinders often obstruct one another. The permanently attached cylinders also limit the usefulness of the washer tossing game because the cylinder cannot be removed or replaced easily.

The purpose of the washer tossing game is to toss washers into round cylinders. Based upon the number of washers successfully tossed into the round cylinders or the closer to the cylinder, the more points a player receives. As the player plays the game, the player's skills improve. Over time, the game becomes less challenging. The game becomes more challenging when the player is required to toss a washer into a taller cylinder. If a player wants to modify the game difficulty using the current washer tossing games, the player is required to utilize either a game with multiple dimensioned cylinders or multiple games with various cylinder sizes. It would be an advantage to have a game in which the center cylinder section could be removed and which could utilize multiple dimensioned cylinders.

Another problem with current washer tossing games is that they are not designed to be readily transported. Many users of washer tossing games often travel some distance into parks or fields. Carrying these games, which are often bulky and unsecured, for any distance can be difficult. It would be an advantage to have a washer tossing game with a securing mechanism which allowed the game to be transported.

Another current configuration of the washer tossing game involves multiple receiving boxes, with multiple round holes placed throughout the box and including multiple washers. While the receiving box provides enjoyment in different environments, the multiple-hole configuration requires a larger, rectangular box, which is often bulky, difficult or awkward to transport. It would be beneficial to have a compact washer tossing game which is portable and capable of being played in a variety of outdoor and indoor environments.

Prior art attempts to address these problems include Weymouth U.S. Pat. No. 5,040,801, which discloses a ground receptacle inserted into the ground with nails and spikes. Husk U.S. Pat. No. 5,533,734 discloses a washer tossing game with multiple washer clearances. Gomez U.S. Pat. No. 6,161,833 discloses a washer tossing game with a mat and a center hole. Kessler U.S. Pat. No. 6,749,201 discloses a stackable washer tossing game. However, heretofore there has not been available a washer tossing game with the advantages and features of the present invention.

SUMMARY OF THE INVENTION

In the practice of the present invention, a washer tossing game is provided which is compact, portable and securable and includes a removable center section. The washer tossing game includes two receiving boxes, each with a removable center section slidably received by a base, multiple washers for tossing into the receiving boxes and a receiver box lining for protecting the receiving box and absorbing the washer impact when the washer is tossed into the receiving box.

DETAILED DESCRIPTION OF THE PREFERRED EMBODIMENTS

I. Introduction and Environment

Figure 3:
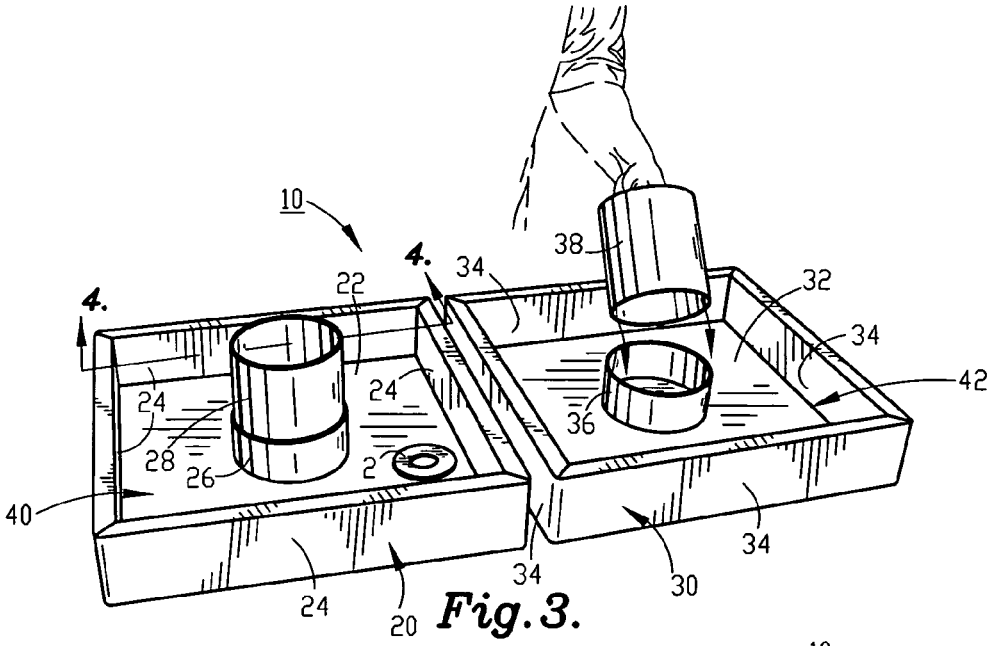
FIG. 3 is an elevation of the game in the open position being assembled.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, top, bottom, front, back, right and left refer to the invention as oriented in the view being referred to. The words "inwardly" and "outwardly" refer to directions toward and away from, respectively, the geometric center of the embodiment being described and designated parts thereof.

Said terminology will include the words specifically mentioned, derivatives thereof and words of similar meaning.

II. Preferred Embodiment Washer Tossing Game 10

Referring to the drawings in more detail, the reference numeral 10 generally designates a washer tossing game including multiple projectiles 2. A storage box 12 comprised of a first receiving box 20 and a second receiving box 30. The game 10, has an open and a closed position. The game also has an assembled and an unassembled configuration. In the open position the game is accessible for participation by players. In the closed position, the game 10 is not accessible and the various game components are stored and able to be transported. In the closed position, the game is generally in the unassembled configuration and while in the open position the game is generally in the assembled configuration for play.

In general, the receiving box 20 has a bottom 22 and a sidewall 24 which define a generally rectangularly-shaped area, though such is not considered limiting and other shapes, such as, circular, square or irregular shapes can also be used and are considered within the scope of the invention. Where a square shaped receiving box 20 is provided, multiple sidewalls 24 are provided with each sidewall 24 being preferably the same.

Figure 1:
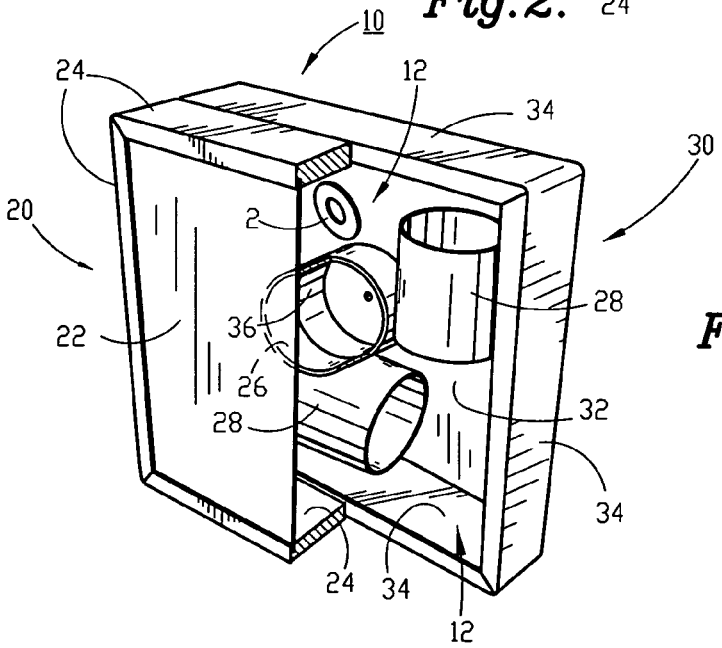
FIG. 1 is a perspective cut-away view of an embodiment of the washer tossing game with the game resting on its right side in the closed unassembled position.

As seen in FIG. 1, a game in accordance with the present invention is illustrated and generally designated as 10 which contains the first and second receiving boxes 20, 30 vertically stacked upon one another in juxtaposed positions with various game components seen in the cutaway view. In the closed position, the first and second receiving boxes, 20, 30 form a storage box 12 by positioning the first and second receiving boxes 20, 30 in juxtaposed positions on one another. The storage box 12 stores the unassembled game components and provides a way to easily transport the game 10 and its various components. In general, the storage box 12 allows the game 10 to be easily stored while not in play and easily transported for play.

The first receiving box 20 includes a first receiver base 26 for slidably receiving a first removable center section 28. The second receiving box 30 includes a second receiving base 36 for receiving a second removable center section 38. In FIG. 1 the first and second removable center sections 28, 38 each having proximate and distal ends, are in the unassembled configuration, generally being stored within the second receiver box 30. Alternatively, the removable center sections 28, 38 could be stored within the first receiving box 20. The projectile 2 is also shown being stored within the second receiving box 30; although preferably, the game 10 would have plural projectiles 2.

Figure 2:
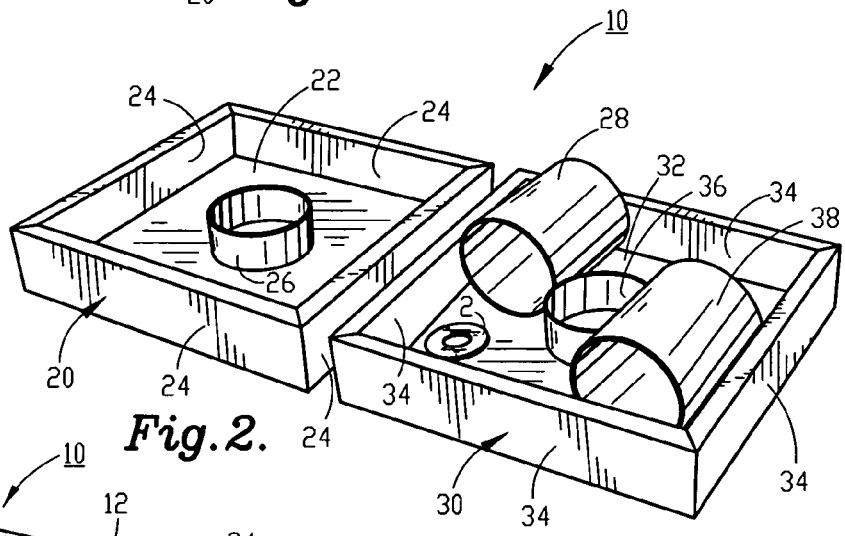
FIG. 2 is a right side perspective view of the game in the open unassembled position.

FIG. 2 illustrates the game 10 in the open configuration with the first and second receiving boxes 20, 30 placed on their bottom, each box 20, 30 being generally similar to each other and each having a bottom, four sidewalls and a storage area. As shown, the first and second receiving boxes 20, 30 have a first and second receiving box bottom 22, 32 which are generally rectangular in shape. The first receiving box 20 has at least one first receiving box sidewall 24, and the second receiving box 30 has at least one second receiving box sidewall 34 said sidewalls being generally perpendicularly connected to the receiving box bottom 22, 32. In the preferred embodiment, the first and second receiving box 20, 30 each have four receiving box sidewalls 24, 34 being generally of equal dimensions.

The first and second receiving box bottoms 22, 32 also have the first and second receiver bases 26, 36 generally secured thereto. The first receiver base 26 being secured to the first receiving box bottom 22 of the first receiving box 20. The second receiver base 36 being secured to the bottom 32 of the second receiver box 30.

The game is shown in an open position in FIG. 3, being assembled with the first receiver base 26 in receipt of the proximate end of the first removable center section 28 with the distal end of the removable center section 28 extending vertically outwardly from the first receiving box 20. The second receiver base 36 of the second receiver box 30 is shown slidably receiving the proximate end of the second removable center section 38. When the removable center sections 28, 38 are slidably received by the receiver bases 26, 36 the game 10 changes from the unassembled to the assembled configuration. The removal of either one or both of the first or second removable center sections, 28, 38 during transportation allows the overall game 10 to be smaller and more easily transported because the various game components can be stored during transportation. In addition, the easy removal and installation of the removable center sections 28, 38 allows for a modifiable and easily adapted game 10 for varying the game difficulty level by installing removable center sections with different longitudinal and radial dimensions to accommodate the varying player's skill level.

FIG. 3 shows a first storage area 40 being located at the intersection of the first receiver box sidewalls 24 and the first receiver box bottom 22 with the intersection of the second receiver box sidewalls 34 and the second receiver box bottom 32 defining a second storage area 42 with the first storage area 40 located internally to the first receiving box 20 and the second storage area 42 located internally to the second receiving box 30.

Figure 4:
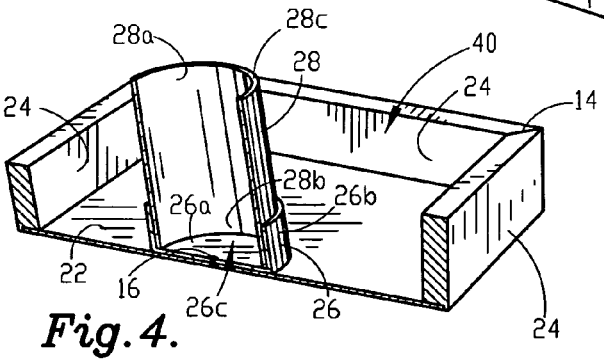
FIG. 4 is the cross-sectional perspective view of the receiver box taken generally along line 4 in FIG. 3.

FIG. 4 illustrates the cross section taken generally along line 4 in FIG. 3. The sidewalls 24 can be seen longitudinally joined to the top surface of the receiving box bottom 26. The sidewalls 24 are also joined together at a joint 14 shown as, but not limited to, a mitered arrangement. The sidewalls 24 are joined to the bottom 26 and define the storage area 40 for receiving the tossed projectile 2. The sidewalls 24 being preferably fabricated from an impact resistant, solid, lightweight material such as a wood or plastic material.

The first receiver base 26 includes a bottom surface 26*a* and a radial side surface 26*b* having an outer and an inner radial surface. The bottom surface 26*a* is adjacent to the first receiver box bottom 22 and preferably located generally in the middle thereof. The radial side surface 26*b* and the bottom surface 26*a* form a base opening 26*c* with the outer radial surface circumscribing the base opening 26*c*. The base opening 26*c* being fitted with a corresponding aperture specially formed for receiving the removable center section 28. Although the base opening 26*c* and the removable center section 28 could have various aperture dimensions, preferably, the base opening 26*c* would be circular to receive a cylindrical, removable center section 28. The first receiver base 26 is located generally in the center of the first receiver box 20 and configured to position the removable center section 28 in an upright position when received by the first receiver base 26.

The first removable center section 28 is preferably cylindrically shaped with a cylindrical shaft having an elongated longitudinal axis with a proximate end 28*a*, a distal end 28*b* and a proximate edge 28*c*, the proximate end 28*a* extending between the distal end 28*b* and the proximate edge 28*c*, the proximate end 28*a* terminating at the proximate edge 28*c*. The removable center section 28 being generally adapted for receiving the tossed projectiles 2.

The first removable center section 28 is made from a stiff, lightweight, impact resistant material such as polyvinylchloride or some other high density plastic material, for example. The first receiver base 26 is designed to receive the distal end 28*b* of the removable center section 28, the bottom surface 26*a* of the base 26 being generally secured to the bottom 22 of the first receiving box 20 using a fastener 16 such as, but not limited to, an adhesive, a rivet, screw or nail. In FIG. 3 the illustrated fastener 16 is a rivet. FIG. 4 illustrates the first removable center section 28 being circumferentially received by the first receiver base 26, wherein the first removable center section 28 extends away from the base 26 and through the storage area 40 of the first receiving box 20.

III. Modified Embodiment Washer Tossing Game

Figure 5:
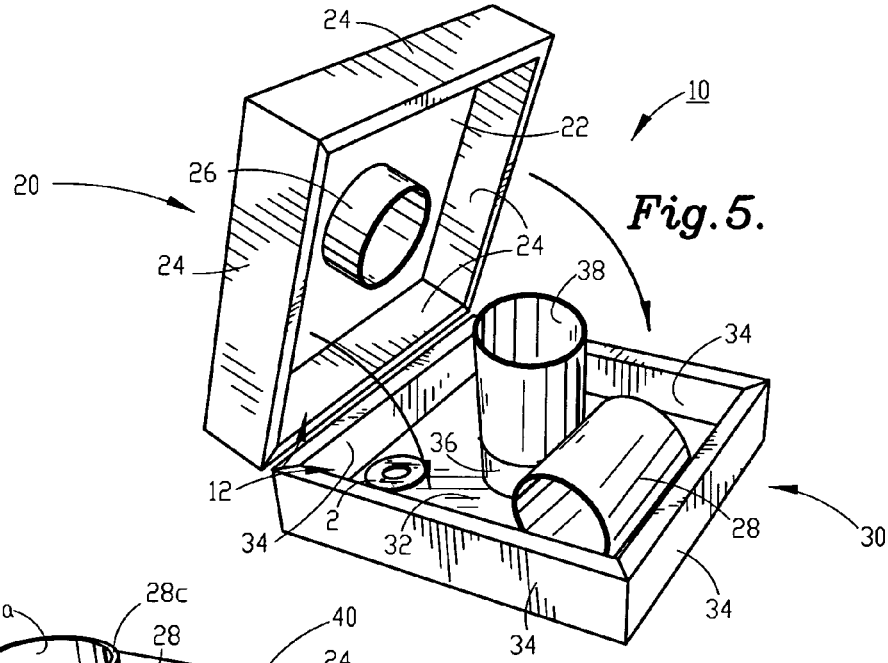
FIG. 5 is a front, right perspective view of the game being closed.

FIG. 5 shows an alternative embodiment with the game 10 being placed in the closed position with one of the first and second removable center sections 28, 38 being received in the first and second receiver bases 26, 36. In this embodiment, the longitudinal axis of the received removable center section is generally the sum of the width of the first and second sidewalls 24, 34, allowing the first and the second receiver boxes 20, 30 when placed in opposing juxtaposed positions to produce the enclosed storage box 12. This is typically accomplished when the proximate end of the second removable center section 38 is inserted into the second receiver base 36 with the first receiver base 26 of the first receiving box 20 adapted to receive the distal end of the removable center section 38. In this embodiment the removable center section frictionally joins both the first and second receiving boxes 20, 30 allowing the game 10 to be secured in the closed position while being transported and stored.

Figure 6:
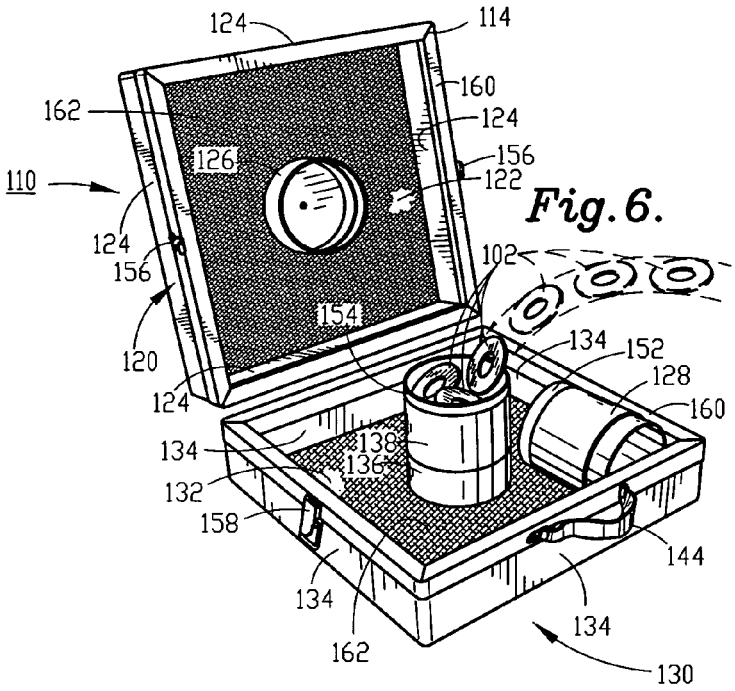
FIG. 6 is a front, right perspective view of an alternative embodiment of the game being closed.
Figure 8:
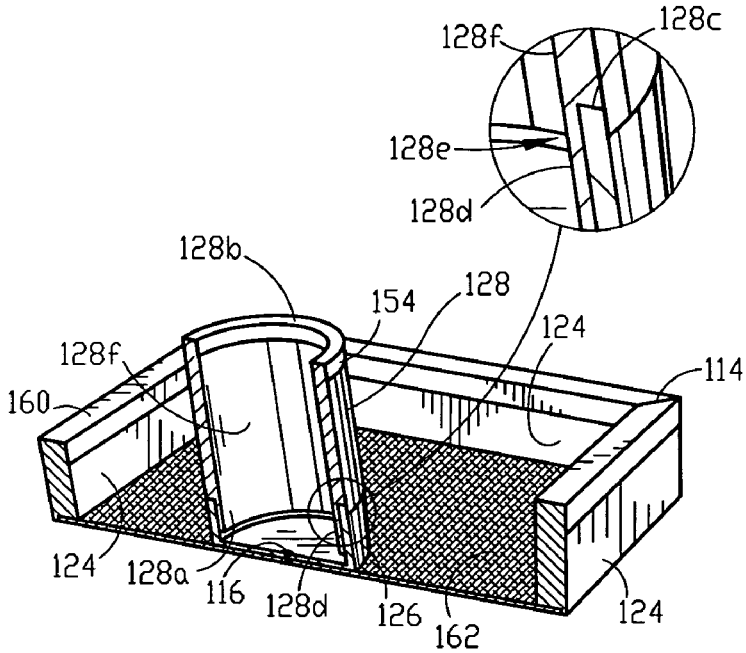
FIG. 8 is a cross-sectional view of the invention taken generally along line 8 in FIG. 7.
Figure 7:
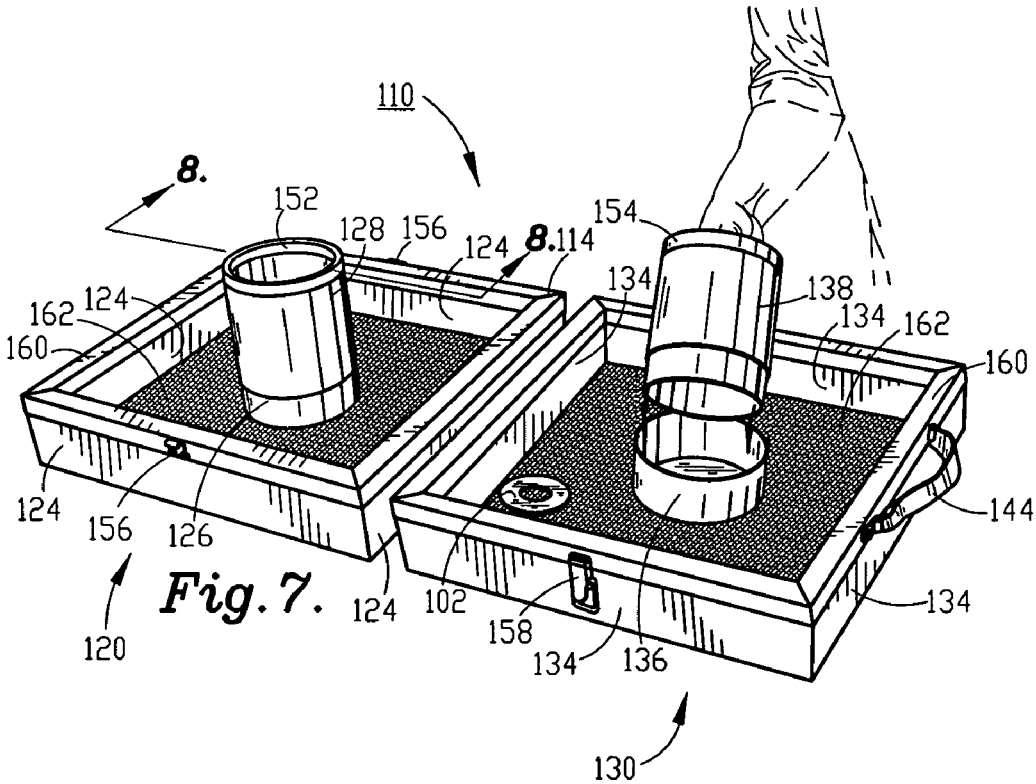
FIG. 7 is a front, right perspective view of an alternative embodiment of the game in the open position.

FIGS. 6, 7 & 8 show a combination of different alternative embodiments of the game 110 including the game with a beveled removable center section in which the first and second receiver bases 126, 136 circumferentially receive at least a portion of the first and second removable center sections 128, 138 in the assembled configuration.

As shown in FIG. 8, the first removable center section 128 has a proximate end 128*a* and a distal end 128*b* separated by an offset region 128*e* with a shoulder 128*c*. The proximate end 128*a* has a lower annular collar 128*d* which extends from the proximate end 128*a* towards the offset region 128*e*. The distal end 128*b* has an upper annular collar 128*f* which extends from the distal end 128*b* towards the offset region 128*e*, the lower annular collar 128*d* having a different outer radius than the upper annular collar 128*f*. Although, there are alternative configurations, including either a single bevel on the receiver base or the removable center section or a dual beveled configuration between the receiver base and the removable center section, preferably, the removable center section would have an exterior bevel and the receiver base would have a single radial surface. FIG. 8 shows the lower annular collar 128*d* having a outer radius smaller than the outer radius of the upper radial collar 128*f*.

In FIG. 6 the removable center section 128 has an inward beveled surface in which the lower annular collar 128*d* has a smaller exterior radius than the upper annular collar 128*f*. The receiver base 126 is adapted to seatably receive the proximate end 128*a* of the removable center section 128 at the shoulder 128*c* wherein the shoulder 128*c* vertically aligns the outer peripheral surface of the upper annular collar 128*f* of the removable center section 128 with the outer peripheral surface of the base 126, the outer surface of the lower annular collar 128*d* of the removable center section 128 being received by the interior of the receiver base 126.

FIGS. 6-8 also show another alternative embodiment in which the first and second removable center sections 128, 138 include a first and second visual indicator 152, 154 along the distal end 128*b*, 138*b* of the removable center section 128, 138. Alternatively, the first and second visual indicators 152, 154 could also be located along the first and second sidewalls 124, 134. The first and second visual indicators 152, 154 will assist players in visualizing the center section when the receiver boxes 20, 30 are located some distance from one another or in poorly lit environments. The visual indicators may include but are not limited to reflective surfaces such as paint or tape or may include some other form of supplemental lighting to help the players visualize the opening.

In addition, as shown in FIGS. 6-8 the first and/or second receiver box sidewalls 124, 134 may optionally include an impact resistant coating or curbing 160 which is located opposite the first and second receiving box bottom 122, 132 extending along the first and second sidewalls 124, 134, forming a protective lip on or around the first and second sidewalls 124, 134. If desired the curbing 160 may be secured to the sidewall.

Another alternative embodiment includes the device 110 with a securing mechanism and a handle 144 adapted to securely close and carry the game 110. The securing mechanism comprised of an eyelet 156 and a hook 158 and the handle 144 are shown in FIGS. 6 & 7 in which the securing mechanism with its eyelet and hook 156, 158 are attached to the first and second sidewalls 124, 134 and the handle 144 is attached to the second sidewall 134. Optionally, as long as the eyelet 156 is located to receive the hook 158 and thus be engaged by the hook 158 the securing mechanism could be located on one of the first and second sidewalls 124, 134 and the handle 144 could be located on both the first and second receiver box sidewalls 124, 134 or even on the first or second receiver box bottom 122, 132. Either way, the game changes from the open to the closed position when the securing mechanism is engaged. Preferably, the game 110 in this alternative embodiment will include at least one handle 144 located on one of the first and second sidewalls 124, 134 and the securing mechanism will be located on at least one of the first and second sidewalls 124, 134.

Although the securing mechanism is shown as the eyelet 156 and hook 158 combination, securing mechanisms are well known and may include hook and latch, lock and key among others and therefore, should not be limited to the securing mechanism shown. When the game 110 is in the closed position, the securing mechanism would be engaged to help secure the game 110 and any of its contents.

FIG. 6 also includes an optional impact absorbing lining 162 to absorb the impact of the tossed projectiles 102 and protect the receiving box bottoms 122, 132.

Figure 10:
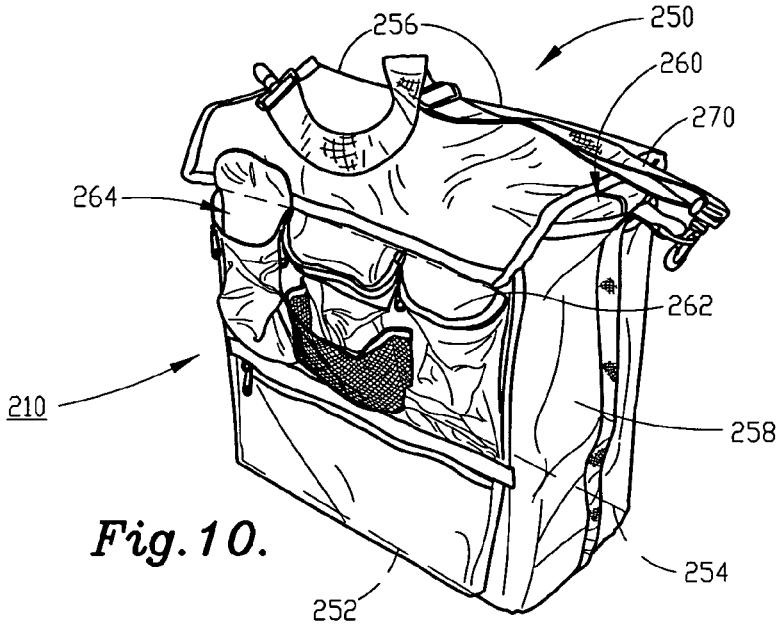
FIG. 10 is a front, right perspective view of an alternative embodiment of the invention in the closed position secured inside a carrying bag.
Figure 9:
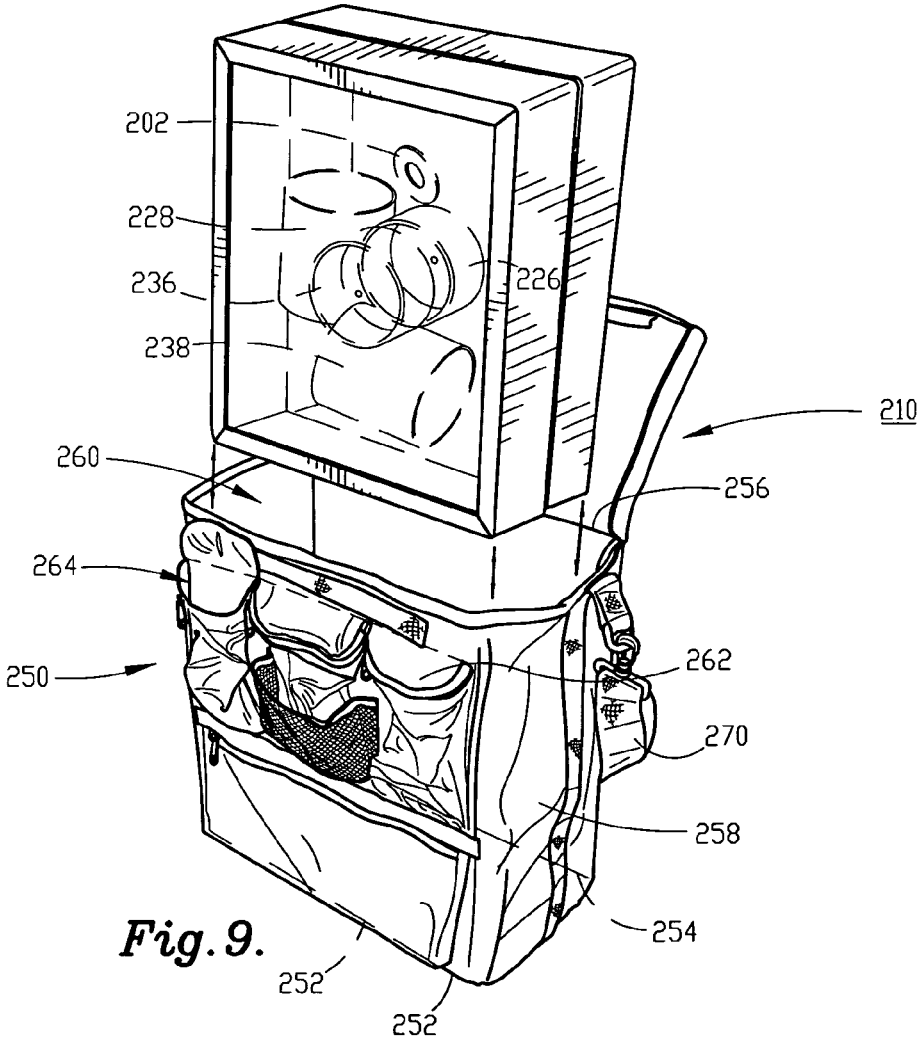
FIG. 9 is a front, right perspective cut-away view of an alternative embodiment of the invention in the closed position being received by a carrying bag.

FIGS. 9 and 10 show another alternative embodiment of the game 210 with a carrying case 250 in which the carrying case is preferably made of a woven material such as, but not limited to, nylon or canvas. The carrying case 250 is formed from plural fold lines forming various sections to hold the game 210. In FIG. 9 the carrying case 250 includes a first fold line 252, a second fold line 254 and a third fold line 256 which extend across a fabric panel in generally parallel positions with respect to one another. The first and second fold lines 252, 254 form a first section 260, which is designed to receive the game 210 in the closed position. FIGS. 9 and 10 also show the carrying case with a side panel 258 for carrying the game 210. In addition, the illustrated carrying case 250 has an optional pocket 264 on the exterior surface of the carrying case 250 for holding or storing various game components such as alternative washers 202 or alternative removable center sections. A carrying strap 270 is also provided which is connected to and extending from the carrying case fabric panel to ease the burden of carrying the game long distances.

Optionally, the carrying case can be used to display a graphical image such as, but not limited to, a sports team or a college insignia to help personalize the game for the player.

It is to be understood that the invention can be embodied in various forms, or configurations and is not to be limited to the examples discussed above. In addition, other components and configurations can be utilized in the practice of the present invention.

Having thus described the invention, what is claimed as new and desired to be secured by Letters Patent is:

1. A washer tossing game for players to score the tossing of plural projectiles, the washer tossing game comprising:

a storage container for storing the game;

a first receiving box;

a second receiving box whereby the first and the second receiving boxes are adapted to stack upon one another in juxtaposed positions to form the storage container;

said first and second receiving boxes each having a bottom and a sidewall, the sidewall being connected to the bottom;

a storage area formed by the intersection of the bottom and the sidewall, said storage area being internal to at least one of the receiving boxes and being adapted for receiving the tossed projectile;

a removable center section adapted to receive the tossed projectile;

a base connected to the bottom of at least one of the receiving boxes, whereby said removable center section is vertically positioned within said base;

said base further including a bottom surface; a side surface, with an inner radial surface and an outer radial surface; and a base opening formed by said bottom surface and said side surface; said bottom surface being adjacent to the bottom of the receiving box; the base opening being adapted for receiving the removable center section.

2. The washer tossing game according to claim 1 wherein the base opening is fitted with a corresponding aperture specially formed for receiving the removable center section.

3. The game according to claim 2 wherein the base opening is generally circular and adapted to slidably receive a cylindrical removable center section.

4. The game according to claim 1 further including a mechanical fastener wherein the bottom surface is secured to the receiving box bottom with the mechanical fastener selected from one of the following: a rivet, a bolt, a nail, a screw or a staple.

5. A washer tossing game for players to score the tossing of plural projectiles, the washer tossing game comprising:

a storage container including a first and a second receiver box with a square bottom and plural sidewalls;

a curbing extending along the length of the sidewalls;

an impact absorbing lining located along the bottom of the receiving box;

a removable center Section with a cylindrical shaft having an elongated longitudinal axis said section including a proximate end extending between a distal end and a proximate edge;

said removable center section having an offset region separating the proximate end and the distal end;

said removable center section including an upper and a lower annular collar said lower annular collar extending from the proximate end towards the offset region, the lower annular collar having an outer radius smaller than the outer radius of the upper annular collar, wherein the offset region joins the upper annular collar and the lower annular collar;

said offset region including a shoulder wherein the removable center section is seatably received by said base at said shoulder, said shoulder vertically aligning the removable center section with the base;

a receiving base having a bottom surface and a side surface forming a base opening said base opening fitted with a corresponding aperture formed for receiving the removable center section said base being generally circular and adapted to slidably receive said bottom surface, said bottom surface being secured to the receiving box bottom with a mechanical fastener;

said game changing from an unassembled configuration to an assembled configuration when the removable center section is slidably received by the receiving base;

said game further including a securing mechanism having a latch hook and eyelet, said game changing from an open to a closed position when the securing mechanism is engaged; and said game including a handle.

6. A washer tossing game for players to score the tossing of plural projectiles, the washer tossing game comprising:

a storage container including a first and a second receiver box with a square bottom and plural sidewalls;

a curbing extending along the length of the sidewalls;

an impact absorbing lining located along the bottom of the receiving box;

a removable center section with a cylindrical shaft having an elongated longitudinal axis said section including a proximate end extending between a distal end and a proximate edge;

said removable center section having an offset region separating the proximate end and the distal end;

said removable center section including an upper and a lower annular collar said lower annular collar extending from the proximate end towards the offset region, the lower annular collar having an outer radius smaller than the outer radius of the upper annular collar, wherein the offset region joins the upper annular collar and the lower annular collar;

said offset region including a shoulder wherein the removable center section is seatably received by said base at said shoulder, said shoulder vertically aligning the removable center section with the base;

a receiving base having a bottom surface and a side surface forming a base opening said base opening fitted with a corresponding aperture formed for receiving the removable center section said base being generally circular and adapted to slidably receive said bottom surface, said bottom surface being secured to the receiving box bottom with a mechanical fastener;

said game changing from an unassembled configuration to an assembled configuration when the removable center section is slidably received by the receiving base;

a carrying case formed from a panel of fabric including a plurality of fold lines extending across said panel in parallel relation to each other, at lease two fold lines forming a section adapted for receiving the washer tossing game; and a carrying strap connected to and extending from said carrying case adapted to transport said game.

7. A washer tossing game for players to score the tossing of plural projectiles, the washer tossing game comprising:

a storage container for storing the game;

a first receiving box;

a second receiving box whereby the first and the second receiving boxes are adapted to stack upon one another in juxtaposed positions to form the storage container;

said first and second receiving boxes each having a bottom and a sidewall, the sidewall being connected to the bottom;

a storage area formed by the intersection of the bottom and the sidewall, said storage area being internal to at least one of the receiving boxes and being adapted for receiving the tossed projectile;

a removable center section adapted to receive the tossed projectile, said removable center section having a cylindrical shaft with an elongated longitudinal axis, a proximate end, a distal end and a proximate edge, said proximate end extending between said distal end and said proximate edge, said proximate end terminating at said proximate edge;

a base connected to the bottom of at least one of the receiving boxes, said base being adapted to receive the removable center section;

said removable center section further including an upper annular collar, a lower annular collar, a shoulder, an offset region positioned between said proximate end and said distal end, whereby said offset region joins the upper annular collar and the lower annular collar;

said upper annular collar extending from said distal end towards said offset region;

said lower annular collar extending from said proximate edge towards said offset region, said lower annular collar having an outer diameter less than the outer diameter of said upper annular collar; and said shoulder located in the offset region wherein the removable center section is seatably received by said base at said shoulder.

* * * * *